US009903019B2

(12) United States Patent
Nixon et al.

(10) Patent No.: US 9,903,019 B2
(45) Date of Patent: Feb. 27, 2018

(54) COMPOSITION FOR THE LOCAL APPLICATION OF CHEMICAL CONVERSION LAYERS

(71) Applicants: Airbus Operations GmbH, Hamburg (DE); EADS Deutschland GmbH, Ottobrunn (DE)

(72) Inventors: Sonja Nixon, München (DE); Martin Beneke, Stuhr (DE); Dominik Raps, München (DE)

(73) Assignees: Airbus Operations GmbH (DE); EADS Deutschland GmbH (DE)

( * ) Notice: Subject to any disclaimer, the term of this patent is extended or adjusted under 35 U.S.C. 154(b) by 663 days.

(21) Appl. No.: 14/064,283

(22) Filed: Oct. 28, 2013

(65) Prior Publication Data

US 2014/0120357 A1 May 1, 2014

Related U.S. Application Data

(60) Provisional application No. 61/719,530, filed on Oct. 29, 2012.

(30) Foreign Application Priority Data

Oct. 29, 2012 (DE) ..... 10 2012 021 241

(51) Int. Cl.
*C23C 22/05* (2006.01)
*C23C 22/73* (2006.01)

(52) U.S. Cl.
CPC ..... *C23C 22/05* (2013.01); *C23C 22/73* (2013.01); *C23C 2222/10* (2013.01); *Y10T 428/31678* (2015.04)

(58) Field of Classification Search
CPC ..... C23C 22/05
See application file for complete search history.

(56) References Cited

U.S. PATENT DOCUMENTS

| | | | | |
|---|---|---|---|---|
| 3,970,482 | A * | 7/1976 | Gunn | C23C 22/74 106/1.05 |
| 6,403,164 | B1 | 6/2002 | Jonschker et al. | |
| 2006/0237098 | A1 * | 10/2006 | Matzdorf | C23C 22/34 148/247 |
| 2011/0033629 | A1 * | 2/2011 | Beneke | C23C 22/34 427/429 |
| 2011/0041957 | A1 | 2/2011 | Brouwer et al. | |
| 2012/0148871 | A1 | 6/2012 | Stormer et al. | |

FOREIGN PATENT DOCUMENTS

| | | | | |
|---|---|---|---|---|
| DE | 196 38 176 | A1 | 4/1998 | |
| DE | 199 23 084 | A1 | 11/2000 | |
| DE | 10 2008 014 465 | A1 | 9/2009 | |
| DE | 10 2009 036 102 | A1 | 2/2011 | |
| EP | 2 463 399 | A1 | 6/2012 | |
| WO | 02/055758 | A2 | 7/2002 | |
| WO | WO 02055758 | A2 * | 7/2002 | C09D 5/084 |
| WO | 2007/134152 | A1 | 11/2007 | |

OTHER PUBLICATIONS

EP 13 188 172.4—Office Action dated Jul. 6, 2017.
Krachler R: "Reaktionsmechanismen in Losungen", Vorlesung Anorganische Chemie II, 2. Teil, Sommer 2009, Universitat Wien [AT], 2009, Seiten 1-37, XP055387103, pp. 30-32. [NOTE: only the portions cited by the EP Examiner have been translated].

* cited by examiner

*Primary Examiner* — Randy Gulakowski
*Assistant Examiner* — Ha S Nguyen
(74) *Attorney, Agent, or Firm* — Lerner, David, Littenberg, Krumholz & Mentlik, LLP

(57) ABSTRACT

An aqueous composition for forming a chemical conversion layer on a metal surface, wherein the composition contains at least one active component for the formation of the chemical conversion layer, as well as at least one thickener, and has a viscosity in the range between 10 mPa*s and 10000 mPa*s.

6 Claims, No Drawings

COMPOSITION FOR THE LOCAL APPLICATION OF CHEMICAL CONVERSION LAYERS

CROSS-REFERENCE TO RELATED APPLICATIONS

This application claims the benefit of the filing date of U.S. Provisional Patent Application No. 61/719,530, filed Oct. 29, 2012, the disclosure of which is hereby incorporated herein by reference.

FIELD OF THE INVENTION

The present invention pertains to a composition and a method for forming a chemical conversion layer.

BACKGROUND OF THE INVENTION

A person skilled in the art is familiar with different options for protecting metals such as, e.g., aluminum from corrosion. These options include, for example, the deposition of metallic coatings, anodic oxidation, the formation of chemical conversion layers or the application of paints and/or lacquers, as well as combinations thereof.

In addition to anodic oxidation, chemically produced conversion layers are particularly important with respect to the corrosion protection, in particular, of aluminum or aluminum alloys.

The term "chemically produced conversion layer" or "chemical conversion layer" is familiar to a person skilled in the art and describes non-metallic and usually inorganic layers on a metal surface that are produced in a chemical reaction with the metallic substrate that is typically realized with a treatment solution, particularly an electrolyte solution, wherein the metal surface is passivated due to the formation of the conversion layer.

Chemical conversion layers can also be formed on metal surfaces other than aluminum or aluminum alloy surfaces.

Chromate conversion layers are usually produced with electrolytes containing hexavalent chromium(VI), particularly with solutions containing hexavalent chromium(VI). However, electrolytes containing hexavalent chromium(VI) represent a significant health risk. Due to these circumstances, methods were developed for producing trivalent chromium(III)-based conversion layers that are free of hexavalent chromium(VI) compounds. Electrolytes containing trivalent chromium(III), particularly aqueous solutions containing trivalent chromium(III), are used for forming trivalent chromium(III)-based conversion layers. Suitable electrolytes containing trivalent chromium (III) for the formation of trivalent chromium(III)-based conversion layers are familiar to a person skilled in the art and described, for example, in DE 196 38 176 A1 and WO 2007/134152.

The formation of the chemical conversion layer and the associated corrosion protection properties are defined, among other things, by the wetting and concentration of the active component in the electrolyte solution and the time of exposure on the metal surface. Another requirement is a sufficient mobility of the active component which typically only exists in a liquid electrolyte solution.

The known methods for producing chemical conversion layers have the disadvantage that only a very thin electrolyte film can be applied onto the surface during a local application. However, the conversion coating process should typically result in a sufficiently thick chemical conversion layer and the formation of cracks in this layer should be simultaneously minimized.

Another disadvantage of the known methods for producing chemical conversion layers can be seen in that the proportioning of the electrolyte or the solution is relatively complicated with conventionally used application means such as a paintbrush or a pencil.

BRIEF SUMMARY OF THE INVENTION

An aspect of the present invention makes available a composition for the formation of a chemical conversion layer on a metal surface that eliminates the problems associated with known compositions. Another aspect of the present invention consists of making available a method for the formation of a chemical conversion layer on a metal surface, in which the problems associated with known methods do not arise.

According to a first aspect, the present invention makes available an aqueous composition for the formation of a chemical conversion layer on a metal surface, wherein the composition contains at least one active component for the formation of the chemical conversion layer, as well as at least one thickener, and has a viscosity in the range of from 10 mPa*s to 10000 mPa*s.

Suitable active components for the formation of a chemical conversion layer are basically familiar to a person skilled in the art. The active component for the formation of the chemical conversion layer is preferably chosen from chromium(III) compounds, vanadium(IV) compounds, phosphomolybdic acid, titanium compounds, zirconium compounds, lanthanum compounds or their combinations or mixtures.

The chromium(III) compound is preferably a chromium (III) salt or a chromium(III) complex. In a preferred embodiment, the chromium(III) salt and/or the chromium(III) complex is chosen from the group consisting of chromium(III) oxy-acids, chromium(III) halides, chromium(III) amine complexes, chromium(III) aquacomplexes, chromium(III) alcohol complexes and chromium(III) acid complexes, preferably $CrF_3$, $CrCl_3$, $CrBr_3$, $CrI_3$, particularly $Cr_2(SO_4)_3$, $Cr(OH)SO_4$ and $Cr_2(SO_4)_3.12H_2O$, $CrPO_4$, $CrPO_4.6H_2O$, $Cr_2(CO_3)_3$.

The ligands of the chromium(III) complex are preferably chosen from the group consisting of: chelate ligands such as dicarboxylic acids, tricarboxylic acids, hydroxycarboxylic acids, particularly oxalic acid, malonic acid, succinic acid, glutaric acid, adipic acid, pimelic acid, suberic acid, azelaic acid, sebacic acid; maleic acid, phthalic acid, terephthalic acid, tartaric acid, citric acid, malic acid, ascorbic acid; acetyl acetone, urea, urea derivatives; complex ligands, in which the complexing functional group contains nitrogen, phosphorus or sulfur, particularly —$NR_2$ and/or $PR_2$, in which case R is independently an organic, particularly aliphatic, radical and/or H, and/or —SR, in which case R is an organic, particularly aliphatic, radical or H; phosphinates and phosphinate derivatives; or their mixtures.

In another embodiment, the chromium(III) compound comprises fluorometallate anions that are preferably chosen from fluorosilicate anions, fluorotitanate anions, fluorozirconate anions or their mixtures.

With respect to suitable titanium and/or zirconium compounds, we refer, for example, to DE 10 2008 014 465 A1.

With respect to suitable lanthanum compounds, we refer, for example, to EP 2 463 399 A1.

The quantity of the active component in the composition can be varied over a broad range. For example, the composition may contain the active component in a quantity between 10 wt. % and 80 wt. % or between 20 wt. % and 70 wt. %.

The inventive composition preferably comprises no chromium (VI) compound.

DETAILED DESCRIPTION

As already mentioned above, the application of known compositions is complicated, particularly due to the low viscosity and therefore the low attainable concentration of the active component in the electrolyte film applied onto the metal surface. In the application of known compositions, a small film thickness may furthermore lead to significantly varying ion concentrations during the formation of the chemical conversion layer due to a drying effect such that the reaction is difficult to control and may result in unsatisfactory corrosion protection properties.

Due to the presence of a thickener, the viscosity of the composition is adjusted to a value in the range of from 10 mPa*s to 10000 mPa*s.

The viscosity is determined by means of a rotating viscometer with cone-and-plate measuring system at 23° C.

Due to the adjustment of a suitable viscosity range, it becomes possible to realize the formation of the conversion layer by means of a diffusion-controlled reaction. Due to the diffusion-controlled application, the kinetics of the layer growth are controlled by the transport of reactive components and the adjustment of the pH-value on the interface. The suitable adjustment of the reaction kinetics causes a crack-free growth of the conversion layer. In this way, the inventive method avoids the problems associated with the dependence on application parameters such as the electrolyte quantity, the replenishment of the electrolyte and the drying of the electrolyte with undefined concentration and undefined circulation processes on the interface.

The composition preferably has a viscosity in the range of from 20 mPa*s to 3000 mPa*s, particularly 50 to 2500 mPa*s.

Conventional thickeners can be used within the scope of the present invention. Thickeners, i.e. additives for increasing the viscosity of solutions or liquids, are basically familiar to a person skilled in the art. Preferred thickeners suitable for use within the scope of the present invention include, for example, cellulose, cellulose ether, starch, oxidized starch, acetylated starch, oxidized-acetylated starch, polyacrylic acid, polyacrylate, polyurethane, polyether or polyolefin. Preferred cellulose derivatives or cellulose ethers include, for example, methyl cellulose, ethyl cellulose, hydroxypropyl cellulose, hydroxypropylmethyl cellulose, methyl ethyl cellulose, sodium carboxymethyl cellulose or their mixtures. Other preferred thickeners for controlling the rheology include, e.g., polyethyleneglycol, polypropyleneglycol, polyvinyl alcohol, as well as thixotropes such as, e.g., silicic acid.

In a preferred embodiment, the composition contains a thickener in the form of cellulose ether such as, e.g., methyl cellulose.

Other commonly used thickeners familiar to a person skilled in the art may be used alternatively or additionally to the aforementioned thickeners. In a preferred embodiment, however, the composition exclusively contains one or more of the aforementioned thickeners.

The quantity of the thickener in the composition can be varied over a broad range. The composition preferably contains the thickener in a quantity of from 0.5 wt. % to 5 wt. %, particularly 1 wt. % to 3 wt. %.

The water content is preferably chosen such that a sufficient solubility of the active component in the composition is realized and the composition furthermore has an advantageous viscosity for the application onto a metal surface.

The aqueous composition may optionally also contain a solvent. Organic and inorganic solvents, as well as their mixtures, may be considered as suitable solvents. Since the active component should preferably be dissolved, particularly polar inorganic and/or organic solvents may be considered. For example, alcohols, ethers or esters may be used.

The inventive composition may contain additives, particularly additives that promote the conversion reaction.

The additives are preferably chosen such that they do not negatively affect the conversion reaction.

In addition, coloring pigments may also be added, wherein these pigments preferably only color the aqueous composition, but not the conversion layer.

The pH-value of the composition can be varied over a broad range. A suitable pH-value may lie, for example, in the range of 0-8.

Since some active components such as, e.g., dissolved chromium(III) ions may form insoluble compounds under basic conditions, it may be advantageous that the inventive composition has a pH-value in the range of 1-7, more preferably in the range of 2-5 or 3-4.

In one embodiment, the composition therefore may contain at least one organic and/or inorganic acid.

According to another aspect, the present invention pertains to a method for forming a chemical conversion layer on a metal surface, in which a composition of the above-described type is provided and the composition is applied onto the metal surface.

Suitable metals that can be provided with a chemical conversion layer are basically familiar to a person skilled in the art.

The metal preferably is aluminum, zinc, magnesium or alloys or combinations of these metals. The metal may also be steel that is optionally galvanized.

The above-described inventive composition can be produced or provided by means of conventional production steps that are basically familiar to a person skilled in the art.

For example, it would be possible to initially produce an aqueous solution of the active component, to which the thickener is subsequently added until the desired viscosity is adjusted.

As already mentioned above, a person skilled in the art is basically familiar with suitable active components for the formation of a chemical conversion layer.

Electrolytes on the basis of chromium(III) for the formation of chromium(VI)-free chromate conversion layers are familiar to a person skilled in the art. In this context, we refer, for example, to DE 196 38 176 A1 and WO 2007/134152 that disclose suitable compositions for the formation of chromium(III)-based conversion layers. For example, a preferred liquid suitable for use within the scope of the present invention is SurTec® 650 RTU or ChromitAL® TCP-Fertiglosung distributed by Surtec GmbH. Other examples of commercially available liquids with an active component for the formation of a chemical conversion layer (i.e. electrolytes) are Henkel Alodine 5923 Plus, Henkel Alodine 871 Metalast TCP-HF and Mac Dermid Interlox 338 in the concentrations suggested by the manufacturers. The thickener can then be added to these chromium(III)-based liquids.

As mentioned above, the composition containing the thickener and the active component is applied onto the metal surface in the next step of the inventive method.

The application of the composition onto the metal surface may be realized with conventional production steps that are basically familiar to a person skilled in the art.

The composition may be applied, for example, by means of coating (e.g. with a paintbrush or a brush or a suitable serrated trowel), wiping or dipping or spraying processes.

The quantity of the composition applied per unit of area or the average thickness of the composition applied in the form of a layer can be varied over a broad range.

The composition can be suitably applied with a surface coverage in the range of from 4 mg composition/$cm^2$ of metal surface to 200 mg composition/$cm^2$ of metal surface, preferably 4 mg composition/$cm^2$ of metal surface to 50 mg composition/$cm^2$ of metal surface, particularly 9 mg composition/$cm^2$ of metal surface to 40 or even up to 100 mg composition/$cm^2$ of metal surface.

The average layer thickness of the composition applied onto the metal surface can be 0.05 mm to 2 mm, preferably 0.1 mm to 1.5 mm.

The composition may also be applied by saturating one or more cloths with the composition or applying the composition onto one or more cloths, wherein the cloth or the cloths is/are subsequently placed onto the metal surface to be treated and left in this position for a sufficient time of exposure. With respect to the application by means of one or more cloths, we refer to DE 10 2009 036 102.

Within the scope of the inventive method, the composition may be applied onto the metal surface to be treated only once or alternatively several times. Due to the utilization of the inventive composition, however, a single application usually suffices.

The composition is preferably left on the metal surface for a time of exposure that suffices for the formation of the conversion layer and then rinsed off.

After the application, the composition is preferably removed from the surface without residue by means of rinsing and/or wiping.

The time of exposure can be varied over a broad range and depends, among other things, on the type of metal surface and the desired thickness of the conversion layer. The time of exposure may lie, for example, between 1-30 minutes, preferably between 3-15 minutes or 4-8 min.

The conversion layer formed in accordance with the inventive method preferably has a corrosion resistance of more than 72 h, preferably more than 168 h, particularly more than 200 h, referred to the salt spray test according to ASTMB117.

The layer thickness of the produced conversion layer can be varied within a broad range with the inventive method. For example, the layer may have a thickness of from 20 nm to 500 nm, preferably 50 nm to 150 nm.

The inventive method is suitable for the treatment of numerous metals. The metals are preferably chosen from the group consisting of aluminum, zinc, magnesium or alloys or combinations of these metals. The metal may also be steel that is optionally galvanized.

In a particularly preferred embodiment, the metal is an aluminum alloy used in the construction of aircraft, particularly of the classes AA2xxx, AA7xxx, AA5xxx, AA6xxx, AlLi and AlMgSc.

The precise application of the inventive composition onto a metal surface to be treated can be significantly simplified by adjusting a suitable viscosity. This also simplifies the control of the thickness and the uniformity of the composition applied onto the metal surface.

As already mentioned above, the formation of the conversion layer in accordance with the inventive method is preferably realized in the form of a diffusion-controlled reaction. Due to the diffusion-controlled application, the kinetics of the layer growth are controlled by the transport of reactive components and the adjustment of the pH-value on the interface. The suitable adjustment of the reaction kinetics causes a crack-free growth of the conversion layer. In this way, the inventive method avoids the problems associated with the dependence on application parameters such as the electrolyte quantity, the replenishment of the electrolyte and the drying of the electrolyte with undefined concentration and undefined circulation processes on the interface.

In order to achieve satisfactory corrosion protection properties, the inventive method only requires a single application and can be easily carried out by the manufacturing personnel.

The present invention also pertains to a chemical conversion layer on a metal surface that is produced with the above-described method.

The invention furthermore pertains to the utilization of the inventive composition for forming a chemical conversion layer on a metal surface.

EXAMPLES

Example 1

The viscosity of a chromium(III)-based electrolyte (ChromitAl SurTec 650, 50%) was adjusted to a value of 60 mPa*s by adding 1 to 2 wt. % methyl cellulose (Methocel 65HG). The application was carried out with a paintbrush (approximately 10 mg composition/$cm^2$). The time of exposure on a ground AA2024 surface amounted to 4-8 min. Subsequently, the electrolyte was completely rinsed off the treated metal surface. The corrosion resistance determined in a salt spray test according to ASTMB117 amounted to more than 168 hours.

The invention claimed is:

1. A method for using a composition containing at least one active component chosen from chromium(III) compounds, vanadium(IV) compounds, phosphomolybdic acid, titanium compounds, zirconium compounds, lanthanum compounds and their combinations and mixtures, as well as at least one thickener, and having a viscosity in the range of from 10 mPa*s to 10000 mPa*s for the diffusion-controlled formation of a conversion layer, comprising:

(i) providing a composition containing at least one active component chosen from chromium(III) compounds, vanadium(IV) compounds, phosphomolybdic acid, titanium compounds, zirconium compounds, lanthanum compounds and their combinations and mixtures, as well as at least one thickener, and having a viscosity in the range of from 10 mPa*s to 10000 mPa*s;

(ii) applying the composition onto a metal surface in a quantity of from 9 mg to 200 mg per $cm^2$;

(iii) leaving the composition on the metal surface for a time of exposure of 1-30 min. and then rinsing the composition off, wherein the composition is applied onto the metal surface by wiping onto the metal surface.

2. The method of claim 1, wherein the composition contains no chromium(VI) compound.

3. The method of claim 1, wherein the at least one thickener is chosen from the group consisting of cellulose, cellulose ether, starch, oxidized starch, acetylated starch, oxidized-acetylated starch, polyacrylic acid, polyacrylate, polyurethane, polyether, polyolefin and combinations thereof.

4. The method of claim 1, wherein the metal is chosen from the group consisting of aluminum, zinc, magnesium, steel and alloys of these metals.

5. The method of claim 1, wherein only a single application of the composition is carried out.

6. The method of claim 1, wherein the composition is applied with at least one of a paintbrush, a brush, or a serrated trowel.

* * * * *